US005173679A

United States Patent [19]

Mount

[11] Patent Number: 5,173,679

[45] Date of Patent: Dec. 22, 1992

[54] THERMOSTATICALLY CONTROLLED SWITCH

[75] Inventor: Mason B. Mount, Mansfield, Ohio

[73] Assignee: Sensors & Switches, Inc., Lexington, Ohio

[21] Appl. No.: 841,592

[22] Filed: Feb. 25, 1992

[51] Int. Cl.[5] ..... H01H 37/36; H01H 37/12

[52] U.S. Cl. ..... 337/323; 337/312; 337/319; 200/83 S

[58] Field of Search ..... 337/312, 313, 314, 315, 337/316, 317, 318, 319, 320, 321, 322, 323; 200/83 S

[56] References Cited

U.S. PATENT DOCUMENTS

| | | | |
|---|---|---|---|
| 3,114,813 | 2/1963 | Durst | 337/319 |
| 3,226,512 | 12/1965 | Durst et al. . | |
| 4,626,819 | 12/1986 | Drapeau | 337/323 |
| 5,101,189 | 3/1992 | Dolza et al. | 337/319 |

*Primary Examiner*—Harold Broome

*Attorney, Agent, or Firm*—Fay, Sharpe, Beall, Fagan, Minnich & McKee

[57] ABSTRACT

A housing (10), (54) defines a well which holds a diaphragm assembly (12). The diaphragm assembly has a stud portion (14) that extends through an aperture in the housing and is biased into the housing by a spring (16). The stud portion defines a channel (18) which is received in a slot between arms of a calibration plate (20). Movement of the calibration plate transverse to the axis of the stud portion engages a cam surface (24) to position the diaphragm, more particularly a dielectric button (34) which engages a switch control member (50). As a fluid in a bulb (32) expands, it causes the diaphragm to expand, moving the control member (50) and one end of spring portion (48) causing contacts (46, 52) to open. The temperature or degree of diaphragm extension at which the switch contacts open is adjusted by rotating a shaft (60). As the stem is rotated, a cam follower (76) and cam (70) interact causing a dielectric actuator (64) to change the bias force, hence pivot point, of spring elements (44).

20 Claims, 3 Drawing Sheets

THERMOSTATICALLY CONTROLLED SWITCH

BACKGROUND OF THE INVENTION

The present invention relates to adjustably controllable switches. It finds particular application in conjunction with capillary thermostat controlled switches for electric and gas ovens, and will be described with particular reference thereto. However, it is to be appreciated that the present invention will also find application in other thermostatic and pressure controls for use not only in home appliances, but also in industrial applications and the like.

Heretofore, range controls, i.e. thermostatic controls for the oven of a range, included a shaft adapted to receive the knob with which the consumer set the temperature of the oven. The shaft was commonly threadedly received in a metal mounting bracket such that rotation of the knob caused the shaft to travel longitudinally. Longitudinal movement of the shaft changed the bias, the mechanical advantage, or a neutral position of a lever arrangement. A bulb was positioned in the oven and connected by a capillary tube with a diaphragm that was also mounted to the bracket of the range control. As the bulb changed temperature, its contained air or other fluid expanded extending the diaphragm. The diaphragm extension interacted with the lever arrangement pivoting the lever to cause an electrical switch to change states. The electrical switch for an electric range was snap acting to permit higher current flows; whereas, for a gas oven, the switch was slow acting for more accurate temperature response at the expense of lower current carrying capacity.

One of the drawbacks of the prior art range controls resided in the difficulty and expense for calibration mechanisms. Temperature calibration was commonly adjusted by turning a threaded member in a threaded bore to adjust the rest position of the diaphragm. First, the pressure of the screwdriver or other tool on the threaded member added a temperature offset to the final calibration. Moreover, even with as many as 80 threads per inch, the amount of movement of the diaphragm assembly for calibration purposes was so small that a lever ratio of about 1:1 or at best 1.5:1 could be achieved. This low lever ratio limited the accuracy of the calibration.

Additional calibrations to the electrical switch, the shaft, and other parts of the control were also done with threaded members received in threaded bores. The cost of the threaded adjustment mechanisms was relatively high.

Another disadvantage of these prior art range controllers was that the threaded engagement of the shaft and bracket fixed the temperature adjustment. Each model required a different threaded shaft and bracket arrangement to accommodate different amounts of travel for different temperature ranges.

Another disadvantage of the prior art range controllers resided in the differing requirements for electric and gas ranges. A different electrical switch and actuator lever arrangement was required for the snap action of the electric range than for the slow acting switch of the gas range. This increased the necessary parts, inventory, and tooling requirements.

Another drawback of the prior art range controls resided in their cost. The prior art controls required numerous threaded members and mating threaded bores for temperature adjustment and calibration, all relatively expensive parts. The prior art range controllers also included numerous elements, such as the actuator lever assembly, which increased complexity and manufacturing cost. The additional parts, complexity, and calibration complexity required additional assembly operations, calibration checks, and the like.

The present invention contemplates a new and improved thermostatically or pressure actuated controller which overcomes the above-referenced problems and others.

SUMMARY OF THE INVENTION

In accordance with the present invention, a control device is provided in which an electrically conducting spring or blade member is mounted in a switch housing. A diaphragm is mounted in the housing for selectively causing the electrically conducting spring member or blade to move into and out of an electrical conductive relationship with a stationary terminal. A shaft member is mounted through the housing for selectively advancing and retreating to adjust a bias on the electrically conductive spring or blade member which adjusts an amount of diaphragm extension necessary to cause the electrically conductive spring or blade member to move in and out of the contact with the stationary terminal.

In accordance with another aspect of the present invention, the shaft member has an outward projecting cam follower which is biased into firm frictional contact with a cam surface. Movement of the cam follower along the cam surfaces moves the shaft longitudinally.

In accordance with a more limited aspect of the present invention, the cam surface projects downward from a mounting bracket attached to the switch housing. The cam surface has a notch adjacent one end such that the shaft must be depressed against the biasing force to move out of the notch and onto the cam surface.

In accordance with another aspect of the present invention, the diaphragm and shaft act directly on the electrically conducting blade.

In accordance with another aspect of the present invention, a dielectric actuator or connector is disposed between the shaft and the electrically conductive blade. The controller can be assembled with either of two actuators. One of the actuators contacts the blade to define a pivot point at which the blade functions as an overcenter, snap-acting switch. The other actuator contacts the blade past the overcenter point such that the electrically conducting blade functions as a slow make/break control.

In accordance with another aspect of the present invention, the diaphragm assembly includes an axially extending stud which extends through a wall of the housing. The stud defines track which slidably receives a calibration member. The calibration member slides transversely relative to the axis of the stud. A cam surface is disposed on the housing adjacent and engaging the calibration member such that the sliding motion of the calibration member cams the diaphragm stud, hence the diaphragm closer and further from the electrically conductive blade.

One advantage of the present invention is that the temperature or pressure adjustment shaft can be die cast and does not require machining operations such as threading.

Another advantage of the present invention resides in its simplicity.

Another advantage of the present invention is that it can be configured as either a snap-acting or a slow make/break control by changing only a small dielectric actuator member.

Another advantage of the present invention is that the diaphragm assembly is easier to mount and more accurately calibratable.

Other advantages of the present invention include fewer parts, simplified manufacturing and calibration, and lower cost.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
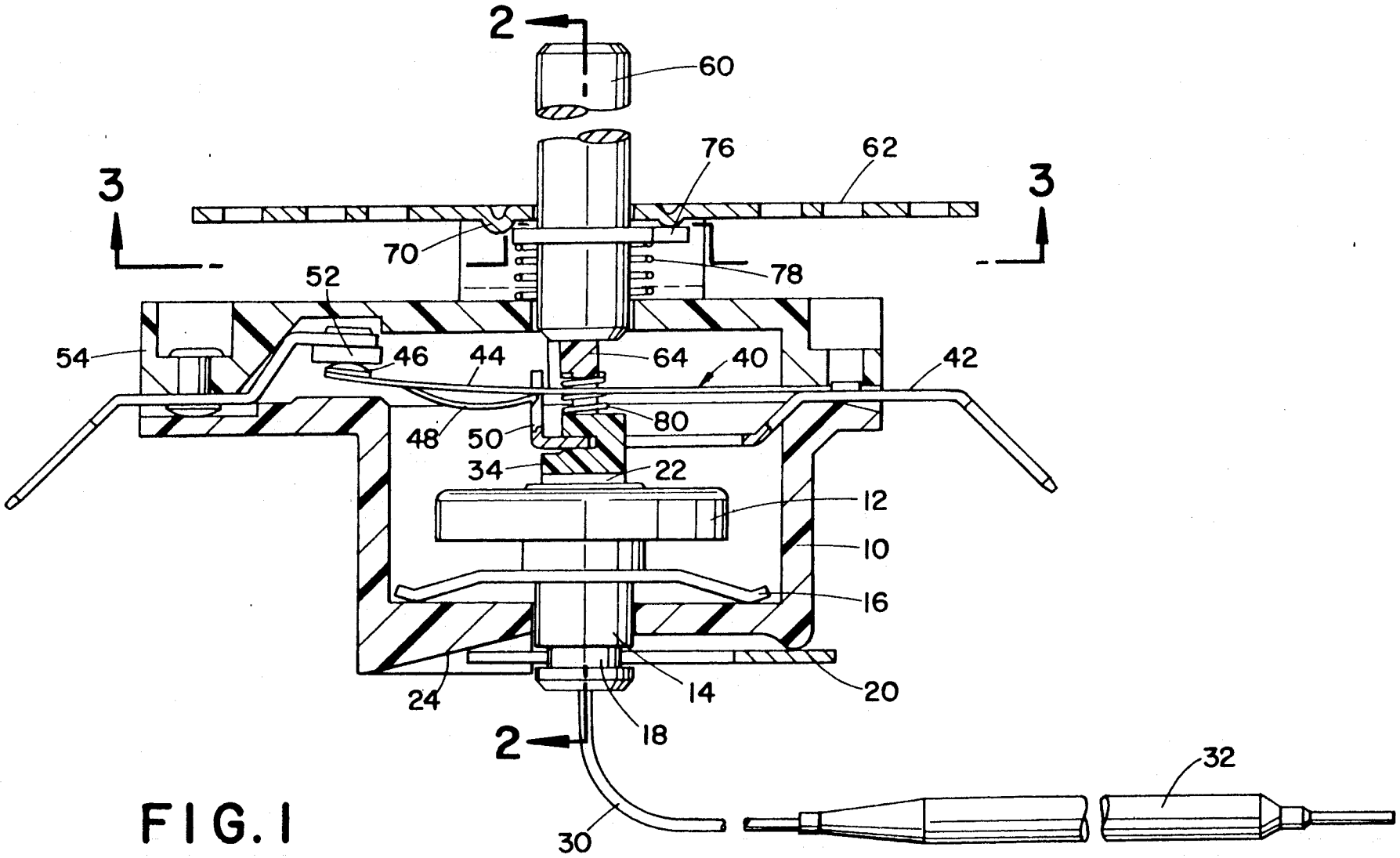
FIG. 1 is a side view in partial section of a snap acting control switch assembly in accordance with the present invention.
Figure 2:
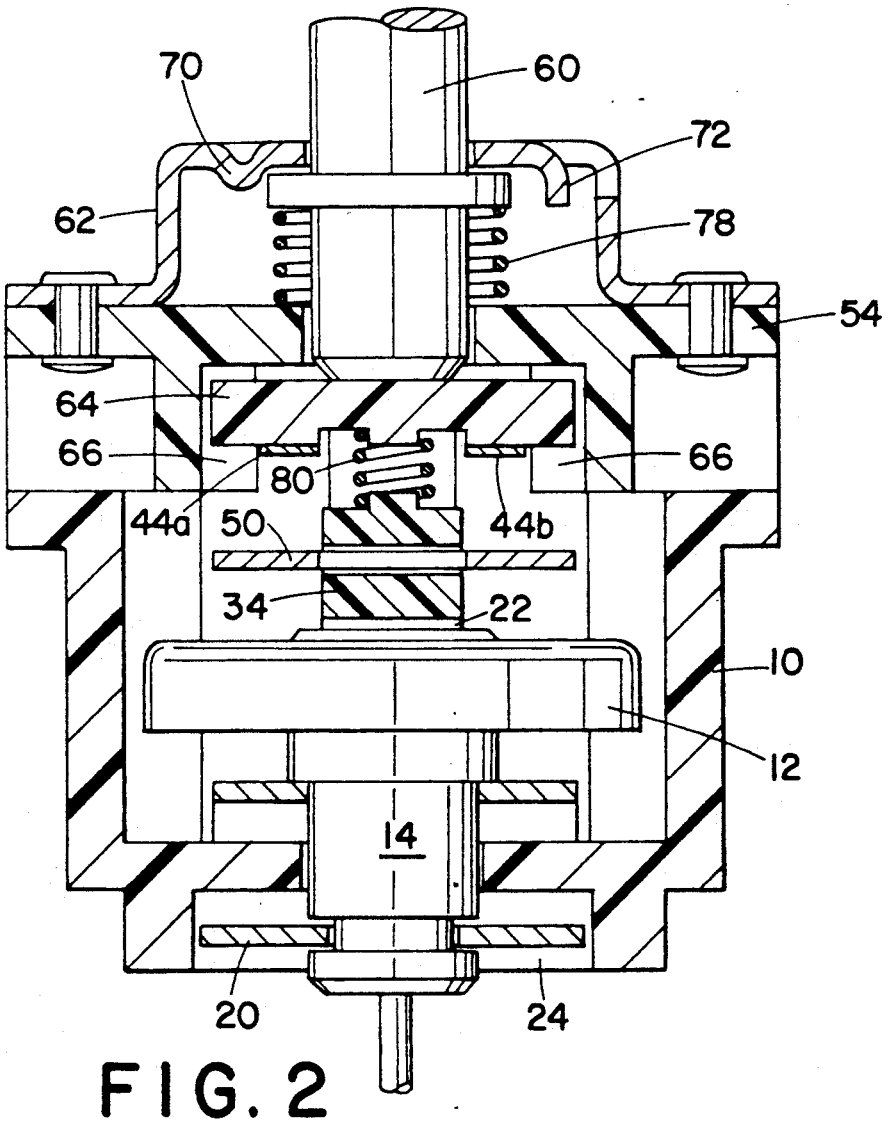
FIG. 2 is an end view in partial section through section 2—2 of FIG. 1.

With reference to FIGS. 1 and 2, a lower dielectric housing portion 10 defines an interior well in which a diaphragm assembly 12 is received. The diaphragm assembly includes a stud portion 14 which extends through a stiff compression spring 16 and an aperture in a bottom wall of the lower housing portion 10. The stud member defines a channel, preferably circumferential groove 18, Which slidably receives tines or arms of a calibration member or plate 20. The calibration plate 20 and the spring 16 precisely position the diaphragm assembly, hence an upper surface diaphragm 22 relative to the lower body portion 10. A cam surface 24 is defined on a lower face of the lower housing portion to engage one end of the calibration plate 20. By shifting the calibration plate transversely to the axis of the stud 14, the position of the diaphragm 22, hence the calibration of the control are selectively adjustable.

A capillary tube 30 extends from the diaphragm assembly 12 to a bulb 32. As the bulb is heated, the fluid inside expands, causing the diaphragm to flex upward (in the orientation of FIGS. 1 and 2). The outer surface of the diaphragm carries a dielectric member or button 34 which engages an electrically conductive switch blade assembly 40.

The electrically conductive blade assembly 40 includes a support and terminal 42 to which a spring or blade member 44 is mounted. The spring member includes a pair of spring segments 44*a* and 44*b* which extend to either side of the diaphragm button 34 defining a central aperture and which converge adjacent a movable electrical contact 46. The spring member also defines a control spring portion 48 which extends under compression between the movable electrical contact 46 and a movable control member 50. The movable control member 50 is received in a slot in the button 34 to be moved with the diaphragm 22. The control spring portion 48 amplifies movement of the button causing the electrical contact 46 to snap overcenter into and out of contact with a stationary electrical contact 52. The stationary electrical contact 52 is riveted to an upper housing portion 54. The movable blade assembly 40 is clamped between the upper housing portion 54 and the lower housing portion 10.

The temperature at which the contacts 46, 52 make and break is adjusted by adjusting the flexing or bias on the spring blade 44. A shaft 60 is movably received through a bore in a mounting bracket 62 and a bore in the upper housing portion 54. The shaft 60 engages a dielectric member or actuator 64 which is received in a track 66 and engages the spring member 44. The actuator 64 is constructed of a dielectric material to insulate the shaft 60 from the electrical conduction path. By selectively moving the shaft 60 axially, a bias on and neutral flex position of the spring member 44 is adjusted which changes the degree of axial extension of diaphragm which causes the contacts 46, 52 to make/-break.

Figure 3:
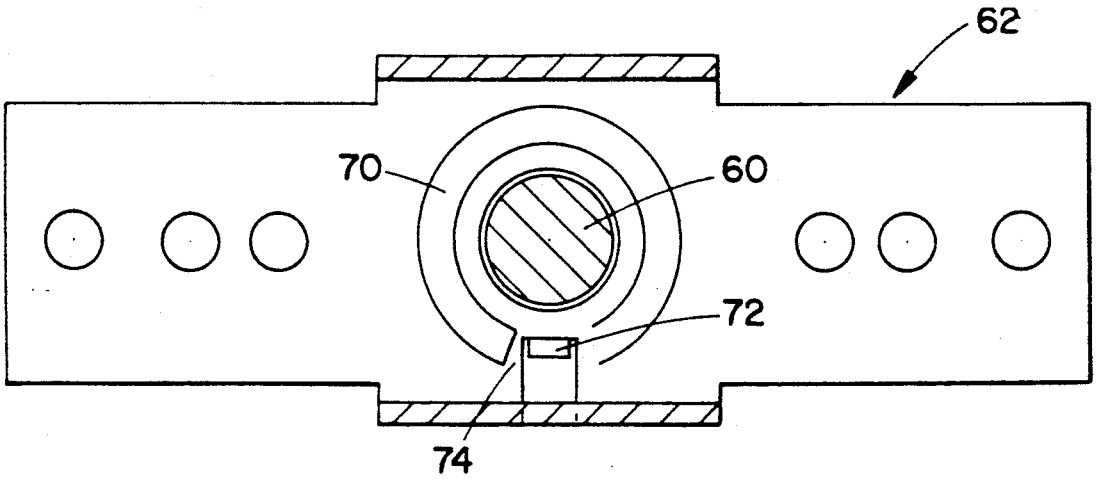
FIG. 3 is a detailed view in partial section along section 3—3 of FIG. 1; and, FIG. 4 is a side view in partial section of an alternate slow make/break embodiment of the present invention.

With reference to FIG. 3, the mounting bracket 62 has a cam surface 70 stamped therein. The cam surface has its least projection or camming action adjacent a stop 72 which is folded down from the mounting bracket 62. The height of the cam surface, hence the degree of camming action increases circumferentially around the shaft 60. Just before the stop 72 at the high end, the circumferential cam surface 70 defines a notch 74. The shaft 60 carries a cam follower 76 which is biased firmly against the cam surface 70 by a spring 75 or other biasing means. As the shaft is rotated, the cam follower follows the cam surface causing the shaft 60 and actuator 64 to move longitudinally toward the diaphragm 22.

In a gas range, the spring 78 biases the cam follower 76 into the notch 74 at a low temperature limit of rotation locking the shaft against rotation. To increase the temperature setting, the stem is depressed against the action of spring 78 lifting the cam follower 76 out of the notch 74 allowing it to rotate along the cam surface 70.

A spring 80 is advantageously provided between the actuator 64 and the diaphragm button 34 for biasing the diaphragm. This assures that the diaphragm retracts as the pressure in the capillary tube drops.

In the electric range embodiment, the actuator 64 contacts the spring blade 44 behind the control member 50. This places the blade in an over-center configuration. That is, on one side of a center point, the control spring portion 48 pushes the electrical contact up against the stationary contact 52. On the other side of the center point, the spring portion 48 flexes, pushing the electrical contact 46 down away from the stationary contact. Very small amounts of movement of the diaphragm are required to shift between the over and under center positions, causing the spring to snap between make and break states. As the temperature adjustment shaft 60 is turned and the interaction of cam surface 70 and cam follower 76 moves the actuator 64 further into or out of the housing, the center point is shifted. Hence, the position at which actuator 50 moves between over and under center positions is shifted.

For different models, the cam track 70 is stamped in the bracket 62 with a different degree of pinch. For example, for a temperature controller with a wider range of temperatures, the cam surface can have a greater difference in height between its two extremes.

As another option, the cam surface can have a relatively flat pitch at one end of the cam surface for low temperatures, changing to a steeper pitch at the other end for less precise control of a wider range of high temperatures. Other variations in the cam surface such as reverse profiles of the cam are also contemplated.

To perform an initial calibration, the shaft 60 is rotated to an angular orientation corresponding to a preselected temperature. The bulb 32 is heated precisely to the preselected temperature. The calibration plate 20 is shifted until the control member 50 is substantially at the center point such that any decrease in temperature will cause the contacts 46, 52 to make and any increase in temperature will cause the contacts 46, 52 to break. Optionally, the calibration procedure may be repeated at several preselected temperatures.

In the preferred embodiment, the calibration plate 20 and the cam surface 24 provide about a 256:1 mechanical gain. Preferably, the lower housing is clamped in a jig which has a threaded shaft extending parallel to the calibration plate. Rotation of the shaft moves a follower that pushes and pulls the calibration plate transverse to the axis of the stud. This provides for very fine positional adjustment of the diaphragm upper surface 22. When the desired calibration is reached, a frangible seal, such as a brittle wax or plastic compound, is applied over at least selected portions of the calibration plate, the diaphragm stud, and the housing bottom wall to provide a visual indication whether there has been tampering with the calibration.

Other calibration mechanisms for shifting the diaphragm assembly axially are also contemplated. For example, the stud can be threaded to receive a nut on the exterior of the housing. Rotation of the nut acting against spring 16 axially positions the diaphragm assembly. In another calibration arrangement, the stud 14 is threaded and engages threads on a lower wall of the lower housing 10. The stud is rotated in the threads to adjust the calibration.

Figure 4:
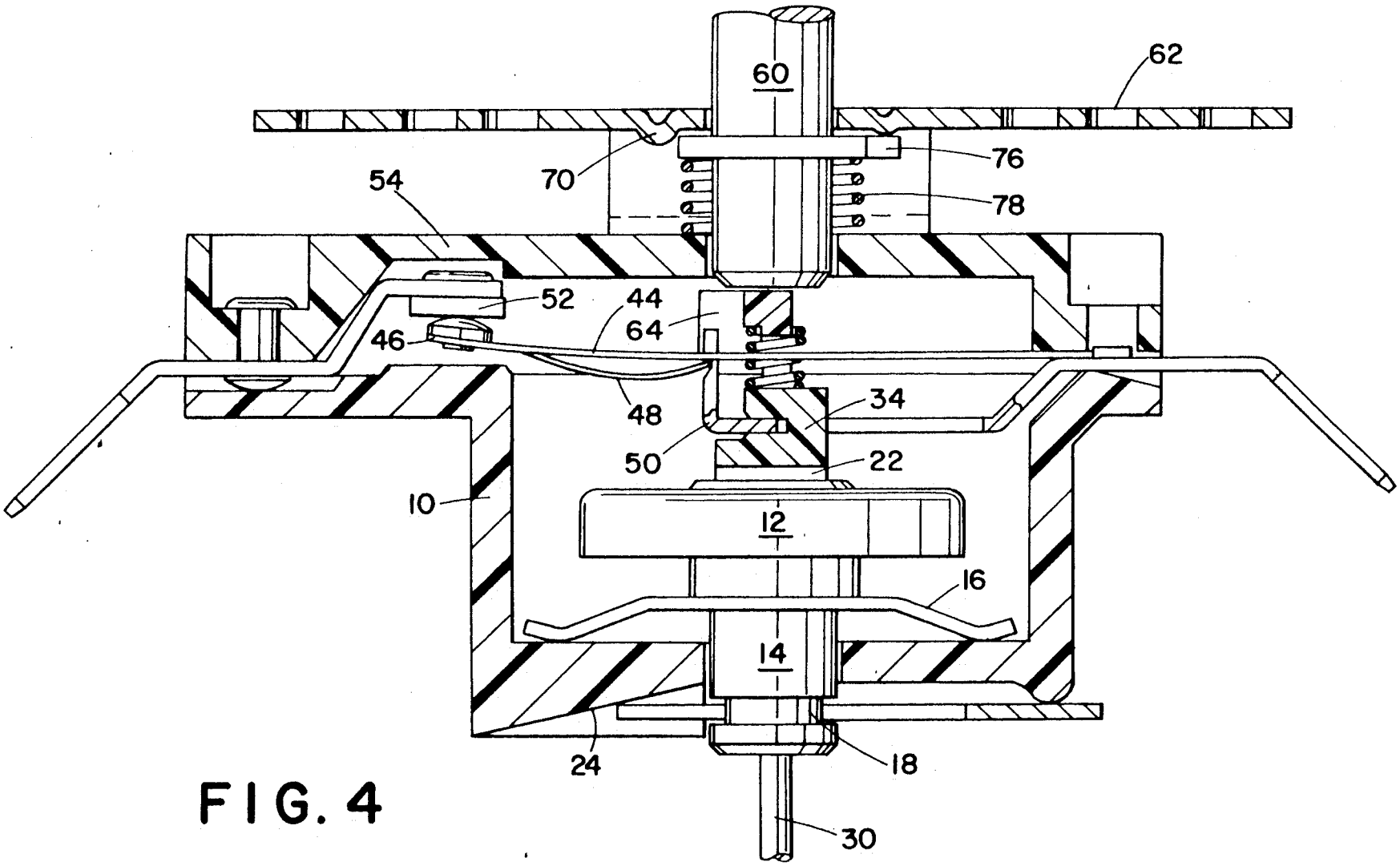

In the embodiment of FIG. 4, all elements of the gas oven controller are the same as in FIGS. 1 and 2, except the actuator 64. In the embodiment of FIG. 4, the actuator 64 engages the spring element 44 on the opposite side of the control member 50. This prevents control spring position 48 from operating in an over-center fashion. Rather, the foreshortened portion of the springs 44*a*, 44*b* move up and down with movement of the control member 50, hence the diaphragm surface 22 in a slow make/break manner. In this way, substantially the same controller is configurable as both a snap-acting and a slow make/break controller by changing only the small dielectric actuator element 64.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A fluid controlled switch assembly comprising:

a first housing portion;

a diaphragm assembly including a diaphragm and diaphragm stud received in a well in the first housing portion with the stud extending through an aperture in the first housing portion;

a calibration means for adjustably moving the diaphragm stud axially in the housing aperture;

an electrically conductive spring blade member having an elongated spring portion and a control spring portion, the spring blade member being mounted to the first housing portion adjacent one end of the spring member and including a control member connected with the control spring portion, the control member being operatively connected with the diaphragm such that the connecting spring portion is moved with movement of the diaphragm, the spring portion supporting an electrical make/break means for selectively making and breaking electrical contact in response to movement of the control member;

an adjustment means which engages the elongated spring member on a surface opposite the diaphragm for adjustably biasing the elongated spring portion.

2. The assembly as set forth in claim 1 further including a second housing portion which closes the first housing portion well and wherein the adjustment means includes a rotatable shaft member having a cam follower that is biased into frictional contact with a cam surface and a dielectric member which engages the elongated spring portion to move the elongated spring portion toward and away from the diaphragm member.

3. The assembly as set forth in claim 2 wherein the shaft member extends through a circular bore in the second housing portion and a bore in a mounting bracket mounted closely adjacent thereto with the cam follower disposed between the mounting bracket and the second housing portion, the mounting bracket defining a projecting cam surface at least partially surrounding the stem member.

4. The assembly as set forth in claim 3 wherein the cam surface includes a notch in which the cam follower is receivable and further including a spring means for biasing the cam follower against the cam surface and into the notch such that the shaft must be shifted axially against the spring member to remove the cam follower from the notch.

5. The assembly as set forth in claim 3 wherein the dielectric member slides along a track parallel to the axis of the shaft.

6. The assembly as set forth in claim 3 wherein the make/break means includes an electrical contact mounted on a free end of the elongated spring portion and a stationary contact supported by one of the housing portions.

7. The assembly as set forth in claim 1 wherein the calibrating means includes:

a cam surface disposed on an exterior of the first housing portion adjacent the stud aperture;

a sliding member which slidably engages the diaphragm stud and which is mounted for sliding movement transverse to a central axis thereof for controlling axial movement of the diaphragm assembly.

8. The assembly as set forth in claim 7 wherein the calibration means further includes a spring member disposed within the first housing portion well for biasing the diaphragm assembly away from the sliding member.

9. The assembly as set forth in claim 8 wherein the diaphragm stud defines a channel and wherein the sliding member includes an arm portion received in the channel and engaging the cam surface, whereby movement of the plate transverse to the axis of the stud and the biasing of the spring member shift the diaphragm assembly relative to the axis of the stud.

10. The assembly as set forth in claim 1 further including a spring means disposed between the adjustment means and the diaphragm for biasing the diaphragm away from the spring blade member.

11. The assembly as set forth in claim 1 further including a sealed capillary tube and bulb containing a fluid which expands with temperature such that movement of the diaphragm is controlled by a temperature of the bulb.

12. A fluid controlled electrical switch assembly comprising:

a diaphragm assembly mounted in a housing, the diaphragm assembly having a diaphragm which flexes in response to changes in pressure in an attached capillary tube to cause an electrical switch to open and close, the diaphragm assembly including a stud portion extending through an aperture in an associated housing, the stud portion defining a channel transverse to a central axis of the stud portion;

a spring means for biasing the diaphragm assembly into the housing;

a calibration member slidably received in the stud portion channel for selective sliding movement transverse to the central axis of the stud portion;

a cam surface engaging the calibration member such that relative movement between the calibration member and the cam surface transverse to the central axis of the stud portion selectively (1) cams the stud portion of the diaphragm assembly against the bias of the spring means pulling the stud portion and diaphragm assembly axially and (2) permits the spring means to move the diaphragm assembly and stud portion axially in an opposite direction.

13. The assembly as set forth in claim 11 further including a sealed bulb connected to the tube such that as the temperature of the bulb changes, a fluid contained therein expands and contracts flexing the diaphragm.

14. The assembly as set forth in claim 12 further including an adjustment means which engages the electrical switch to adjust an amount of flexing of the diaphragm that causes the electrical switch to open and close.

15. The assembly as set forth in claim 14 wherein the adjustment means includes:

a rotatable shaft member for engaging the electrical switch;

a cam follower connected with the shaft member;

a biasing means for biasing the cam follower into engagement with a second cam surface such that rotation of the shaft member extends and retracts the shaft member.

16. The assembly as set forth in claim 12 wherein the stud portion channel includes a circumferential groove and the calibration member includes a plate having two arm portions which define a slot that therebetween, the two arm portions being slidably received in the circumferential groove.

17. A fluid controlled switch assembly comprising:

a housing which holds a diaphragm assembly and an electrical switch which is caused to change states in response to movement of a diaphragm of the diaphragm assembly, the diaphragm flexing in response to pressure in an attached tube;

a mounting bracket mounted adjacent and spaced from the housing;

aligned bores through the housing and bracket for rotatably receiving a shaft;

a cam surface projecting from the mounting bracket circumferentially around the shaft receiving bore, the shaft having a cam follower projecting therefrom for selectively engaging the cam surface;

a biasing means for biasing the cam follower into firm frictional contact with the cam surface;

an actuator mounted between the shaft and the electrical switch for selectively adjusting a bias thereon to control a degree of diaphragm movement which causes the electrical switch to change states.

18. The assembly as set forth in claim 17 further including a sealed bulb connected to the tube such that as the temperature of the bulb changes, a fluid contained therein expands and contracts flexing the diaphragm.

19. The assembly as set forth in claim 17 further including a calibration means for selectively moving the diaphragm assembly closer to and further from the electric switch.

20. The assembly as set forth in claim 19 wherein the calibration means includes a sliding member which is slidably received through a channel in the diaphragm assembly for sliding movement transverse to the movement of the diaphragm assembly, the sliding member engaging a cam surface such that interaction of the sliding member and the cam surface causes the diaphragm assembly movement.

* * * * *